US007917049B2

(12) United States Patent
Thayer et al.

(10) Patent No.: US 7,917,049 B2
(45) Date of Patent: Mar. 29, 2011

(54) VARIABLE INTERFERENCE CLEANING BLADE METHOD

(75) Inventors: Bruce E Thayer, Webster, NY (US); Richard W Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 504 days.

(21) Appl. No.: 12/136,087

(22) Filed: Jun. 10, 2008

(65) Prior Publication Data

US 2009/0304407 A1 Dec. 10, 2009

(51) Int. Cl.
*G03G 15/00* (2006.01)
*G03G 21/00* (2006.01)

(52) U.S. Cl. ..... 399/71; 399/351

(58) Field of Classification Search ..... 399/71, 399/345, 350, 351

See application file for complete search history.

(56) References Cited

U.S. PATENT DOCUMENTS 5,208,639 A 5/1993 Thayer et al.
2010/0053293 A1* 3/2010 Thayer et al. ..... 347/103

FOREIGN PATENT DOCUMENTS

JP 06180542 A * 6/1994

OTHER PUBLICATIONS

Machine Translation of JP 06180542 A.*
U.S. Appl. No. 11/877,770, filed Oct. 24, 2007 and entitled Long Life Cleaning System With Replacement Blades by Bruce E. Thayer et al.
U.S. Appl. No. 12/021,500, filed Jan. 29, 2008 and entitled Dual Blade Cleaning System by Bruce E. Thayer et al.
U.S. Appl. No. 12/136,086, filed Jun. 10, 2008 and entitled Method for Adjusting Cleaning Blade Load on a Photoreceptor by Bruce E. Thayer et al.
U.S. Appl. No. 12/136,088, filed Jun. 10, 2008 and entitled Cleaning Method for Compensating for Environmental Conditions and Blade Age in a Cleaning Subsystem by Bruce E. Thayer et al.

* cited by examiner

*Primary Examiner* — David M Gray
*Assistant Examiner* — Gregory H Curran

(57) ABSTRACT

A control method for monitoring the cleaning performance of a single or multiple blade xerographic cleaning subsystem includes looking at the photoreceptor post-cleaner with a full width array sensor and adjusting the blade load on the photoreceptor to the minimum required to maintain effective cleaning. Blade load is adjusted using a stepper motor. Monitoring of cleaning failures can be done during non-print time, when a toner patch is developed to evaluate cleaning. Readjustment is needed periodically since environmental stresses can change, and the blade ages due to set and wear. Two toner patches at the ends of the blade with two stepper motors can be used to assure the same load from end to end.

17 Claims, 6 Drawing Sheets

VARIABLE INTERFERENCE CLEANING BLADE METHOD

Cross referenced and commonly assigned U.S. application Ser. No. 11/877,770, filed Oct. 24, 2007 and entitled LONG LIFE CLEANING SYSTEM WITH REPLACEMENT BLADES by Bruce E. Thayer et al. now U.S. Pat. No. 7,783,210; and U.S. application Ser. No. 12/021,500, filed Jan. 29, 2008 and entitled DUAL BLADE CLEANING SYSTEM by Bruce E. Thayer et al., now U.S. Pat. No. 7,715,776; U.S. application Ser. No. 12/136,086, filed Aug. 31, 2010 and entitled METHOD FOR ADJUSTING CLEANING BLADE LOAD ON A PHOTORECEPTOR by Bruce E. Thayer et al., now U.S. Pat. No. 7,787,793; U.S. application Ser. No. 12/136,088, filed Jun. 10, 2008 and entitled CLEANING METHOD FOR COMPENSATING FOR ENVIRONMENTAL CONDITIONS AND BLADE AGE IN A CLEANING SUBSYSTEM by Bruce E. Thayer et al., now U.S. Pat. No. 7,817,933; all of which are included in their entirety herein by reference.

This disclosure relates to an electrostatographic printing system that employs an imaging device, and more particularly, to cleaning residual toner from a charge retentive surface of the imaging device.

Electrostatographic machines including printers and copiers form a latent image on the surface of photosensitive material which is identical with an original image, brings toner-dispersed developer into contact with the surface of the photosensitive material, and sticks toner particles only onto the latent image with electrostatic force to form a copied image on a copy sheet. Thus, a toner image is produced in conformity with the original image. The toner image is then transferred to a substrate and the image affixed thereto to form a permanent record of the image to be produced. Although a preponderance of the toner forming the image is transferred to the substrate during transfer, some toner invariably remains on the charge retentive surface of the photosensitive material, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the charge retentive surface be cleaned therefrom for quality images to be produced by the machines.

"Blade cleaning" is a technique for removing toner and debris from a photoreceptor. In a typical application, a relatively thin elastomeric blade member is supported adjacent to and transversely across the photoreceptor surface with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, conventional blade cleaning systems suffer from short life due to early, random failures. Attempts to identify blade materials that possess better reliability and enable dramatic life improvements have not been successful. Introduction of additional blade lubrication can significantly improve blade reliability and life, but adverse interactions with other xerographic systems frequently occur. The introduction of photoreceptor surface coatings has improved photoreceptor life, but these coatings typically result in far higher blade wear rates. Improvements from the introduction of additional lubrication are typically more than offset by the use of coated photoreceptors.

Cleaning blades are typically designed to operate at either a fixed interference or fixed blade load as disclosed in U.S. Pat. No. 5,208,639 which is included herein by reference. Because of blade relaxation and blade edge wear over time, part and assembly tolerance, and cleaning stresses from environmental conditions and toner input, the cleaning blade is initially loaded to a blade load high enough to provide good cleaning at extreme stress conditions for all of the blade's life. For most of the blade's life its blade load is higher than required for good cleaning. For some blades the extreme stress conditions that the initial blade load is designed for will never occur. A negative result of the blade load being higher than required for good cleaning is that the blade and charge retentive surface wear more quickly. Overcoated charge retentive surfaces have been developed to reduce the wear rate. However, these overcoats have also increased the wear rate of the blades.

Accordingly, there is an unmet need for systems and/or methods that facilitate overcoming the aforementioned deficiencies.

In accordance with various aspects described herein, systems and methods are described that facilitate cleaning a charge retentive or photoreceptor surface in a xerographic imaging device using cleaning blades. For example, a cleaning apparatus for a moving photoreceptor surface comprises a cleaning unit with a blade holder that rotates about a pivot point to adjust blade interference to provide the minimum load for high quality cleaning. A stepper motor is used to increase or decrease interference of the blade to the photoreceptor surface. A full width array (FWA) sensor is used to monitor the photoreceptor surface after the cleaner. When toner past the cleaning blade is detected, the stepper motor increases blade interference until the blade load is high enough to eliminate the cleaning failure. Monitoring for cleaning failures can be during printing operation and can be during a non-printing cycle when a developed toner patch is used to evaluate cleaning. Interference is reduced during the non-printing cycle until a cleaning failure occurs at the minimum blade load for cleaning. Operating at the minimum load reduces blade and photoreceptor wear for longer life. Finding the minimum load for inboard and outboard patches aligns the blade to the photoreceptor.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
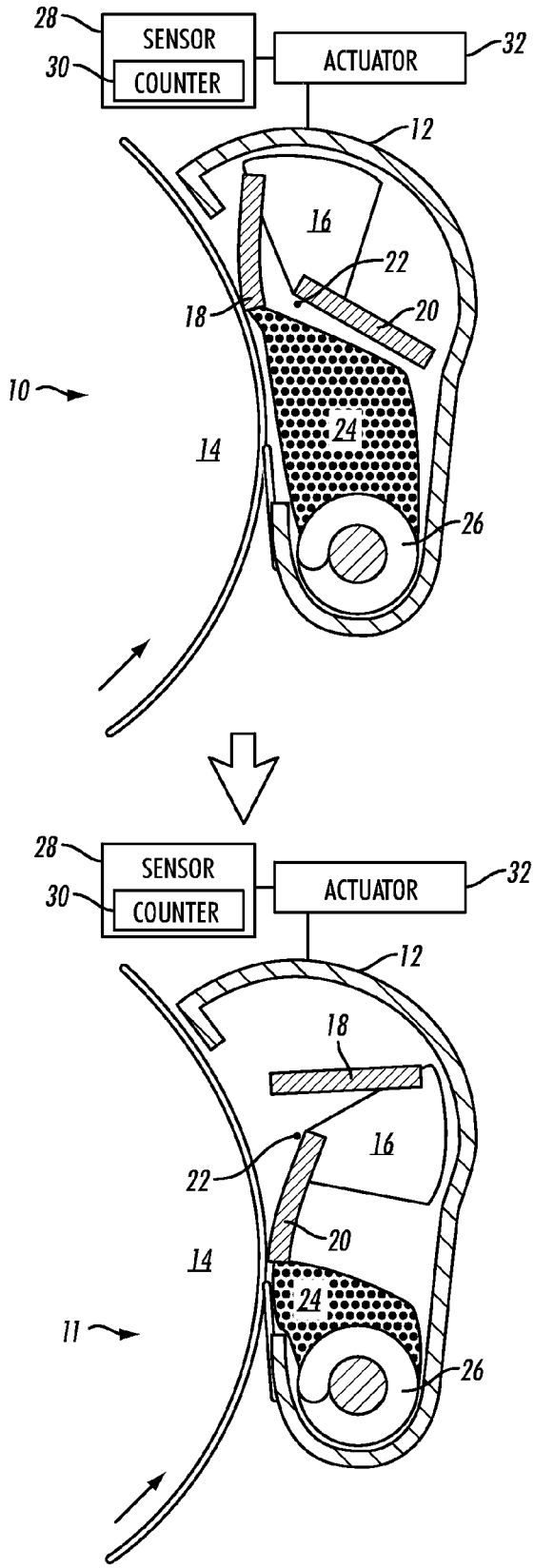
FIG. 1 is a side view of a cleaning system that enables blade cleaning performance sensing and adjustment of blade to photoreceptor interference.

With reference to FIG. 1, a system is illustrated that facilitates replacing a used cleaning blade with a cleaning blade at the end-of-life (EOL) of the used cleaning blade, or at any other desired replacement time while simultaneously adjusting blade interference to provide the minimum load high quality cleaning. The system is illustrated in a first orientation 10 wherein the first cleaning blade is in use, and in a second orientation 11, wherein the second cleaning blade is in use. The system comprises a cleaner unit 12, that is in operational contact with a photoreceptor 14, and houses a blade holder 16, which in turn has a first blade 18 and a second blade 20 attached thereto. The blade holder 16 pivots about a pivot point 22 to position the first or second blade against the surface of the photoreceptor 14, which has a direction of rotation indicated by the arrow at the bottom of the photoreceptor 14 (e.g., counterclockwise in this example). The blade, when placed against the surface of the photoreceptor 14, removes excess waste toner 24, which is directed toward a toner removal auger 26 that removes the waste toner 24 from the cleaner unit 12. Waste toner 24 may then be discarded, recycled, etc. Though some examples provided describe a system for cleaning moving photoreceptor surfaces 14, the cleaning system can also clean other image forming device moving surfaces, including but not limited to moving transfer surfaces such as biased transfer belts, biased transfer rolls, or intermediate transfer belts.

The system further comprises a sensor 28 that senses status information related to print quality, toner build-up, blade wear, or any other suitable parameter for determining an appropriate time for switching blades. The sensor can comprise one or more counters 30 that facilitate determining when to change a blade. An actuator 32 performs the blade change, and may be manual (e.g., a knob, lever, cam, or other actuating means that an operator manipulates to effectuate the blade change) or automatic (e.g., a motor, solenoid, etc.) that changes the blade in response to a sensed blade change condition.

Thus, the system comprises a compact cleaning blade unit having two or more blades that are positioned so that toner flow is not impeded and so that accumulated toner does not apply pressure to the operating blade. Simple rotation of the blade holder removes a used blade and replaces it with a new blade. The photoreceptor surface can be stationary or moving backwards from normal operation during blade replacement. The sensor 28 detects accumulated blade use in one or more ways. For instance, the counter 30 can measure blade use as a function of a number of prints and/or as a function of photoreceptor cycles.

Figure 2:
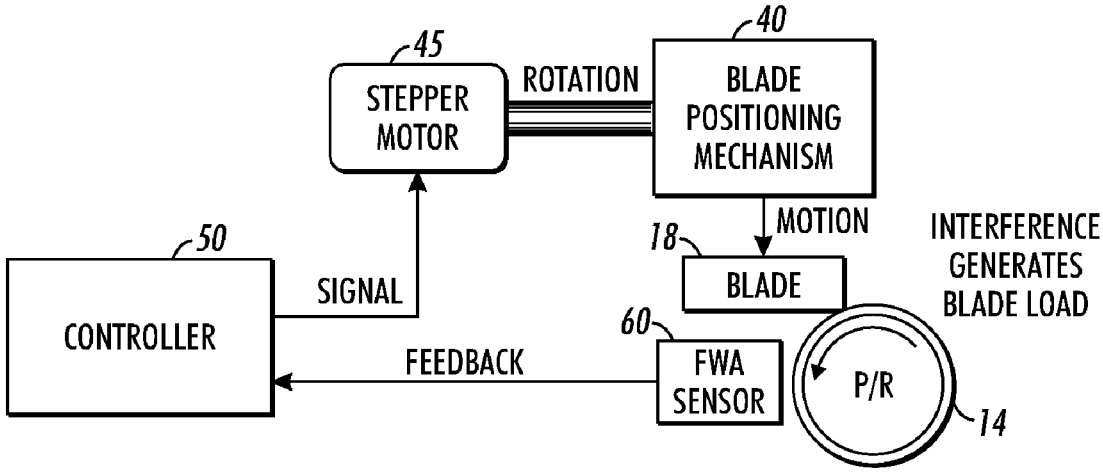
FIG. 2 is a schematic of a single stepper motor system used in the cleaning system of FIG. 1 to control blade load to the minimum required for cleaning.

In accordance with the present disclosure and as disclosed in FIG. 2, rotation of blade holder 16 through blade positioning mechanism 40, which could be a shaft or other conventional mechanism, controls the amount of interference for each blade in the assembly. By controlling the amount of rotation, the blade load can be varied. A stepper motor 45 is used to provide rotation of blade holder 16 in defined increments. Full width array (FWA) sensor 60 is positioned after cleaner 12 to provide a detection system for streaks of toner passing under the cleaning blade. The output from the FWA sensor is input to a controller 50. Controller 50 sends a signal to stepper motor 45 to increase blade interference until feedback from the FWA sensor 60 indicates that the cleaning defect has been eliminated. Because cleaning failures are visible on the surface of photoreceptor 14 well before they are visible on prints, the operator on the machine will be unaware of any cleaning problem and cleaning monitoring need not be continuous.

The method or process described hereinabove maintains the cleaning blade load above the minimum load for cleaning. This is useful for preventing cleaning failure for preventing cleaning failures during operation of the machine, but it does not optimize cleaning blade life. To optimize cleaning blade life, the blade load must be kept at the minimum load for cleaning. This will result in the lowest possible wear on the cleaning blade and the photoreceptor while still maintaining good cleaning. If blade interference is increased to increase blade load during a high temperature stress condition, then the blade load will be higher than required for good cleaning when the temperature returns to normal or cold conditions. A procedure is required for reducing cleaning blade load once the stress condition requiring a higher blade load no longer exists.

Figure 3:
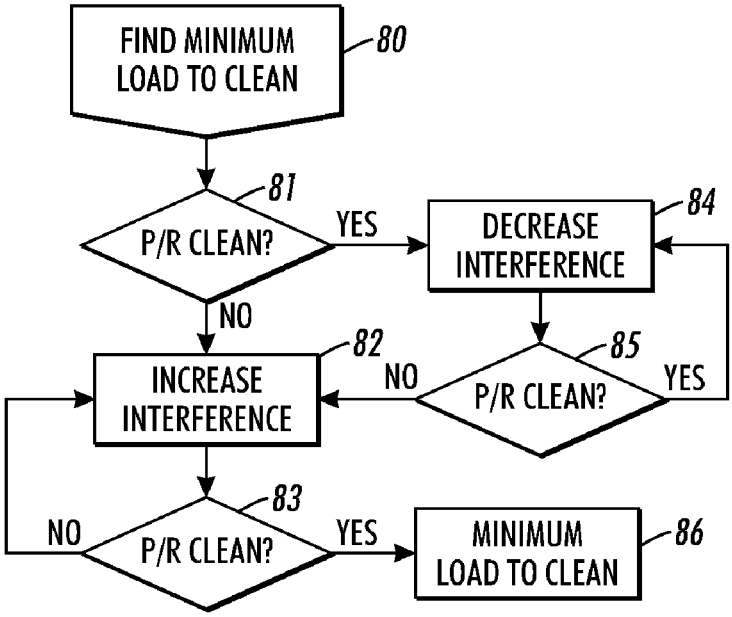
FIG. 3 is flowchart of the process to determine minimum blade load to clean for a single stepper motor system.

Accordingly, and accordance with another aspect of the present disclosure, a procedure for reducing cleaning blade load once the stress condition requiring a higher blade load no longer exists is disclosed that includes development of a toner patch for cleaning evaluation. The toner patch is not transferred, but enters the cleaner as a high density stress image. As shown in the flow chart of FIG. 3, the process of finding the minimum load to clean the photoreceptor is initiated in block 80 and a decision is made in block 81 as to whether the photoreceptor is clean or not. If the FWA sensor 60 detects toner past the cleaning blade, then the blade interference is increased in block 82 and toner is again sensed by the FWA sensor with this procedure continuing in decision block 83 until the minimum load for cleaning the photoreceptor is reached in block 86. If the FWA sensor does not detect toner past the cleaning blade in block 81, then the blade interference is decreased in block 84 until the minimum load for cleaning is reached. Since this process generates toner streaks past the cleaning blade, it is best preformed during non-printing operation of the machine. This could be during a special cleaning evaluation cycle or preferably during machine cycle-up, cycle-down or even in inter-document zones.

An advantage of the cleaner configuration of FIG. 2 with a FWA sensor to detect cleaning failures is the capability of adjusting blade interference over time to compensate for blade set that otherwise would result in a loss of blade load due to blade material relaxation under prolonged strain. Similarly, changes in blade material modulus due to environmental changes in humidity and temperature can be compensated for by changing interference. Blade material response to relaxation or environmental performance removes relaxation and environmental considerations as constraints on blade material selection.

Figure 4:
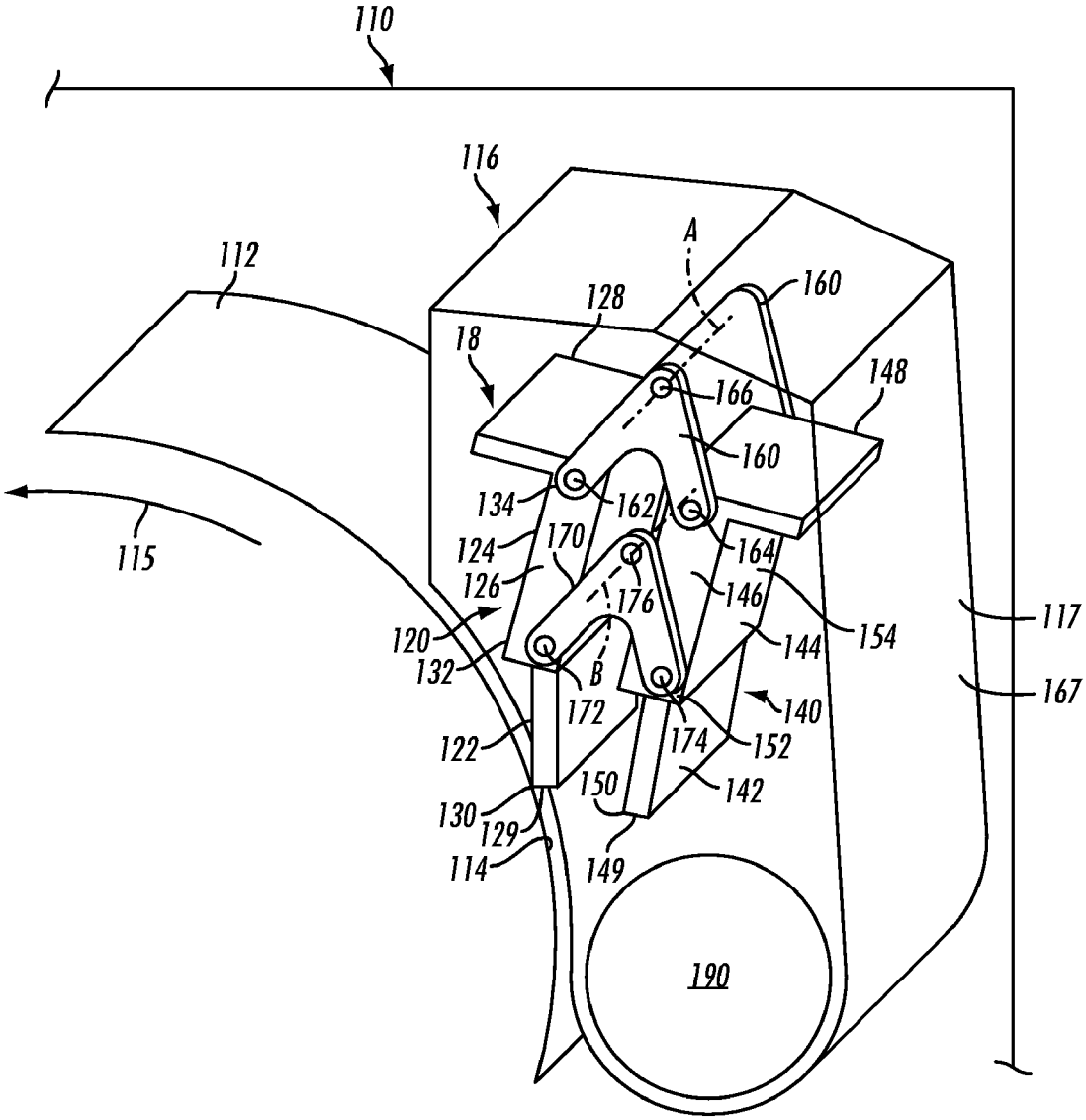
FIG. 4 is a perspective view illustrating an alternative two blade cleaning system having a doctor blade arrangement as described herein with a first cleaning blade disposed in the cleaning position.

Another two blade cleaning system is shown in FIG. 4 where an image forming device is shown generally at 110. The image forming device 110 can be a copier, such as a xerographic copier, a printer, multifunction device or other device having a photoreceptor 112 for forming an image on a substrate such as for example paper (not shown), having a moving surface 114 which moves in an operational direction shown generally by arrow 115.

The image forming device 110 includes a cleaning system, shown generally at 116, for cleaning toner particles, residue and other materials from a moving photoreceptor surface 114. Though some examples provided describe a system for cleaning moving photoreceptor surfaces 114, the system 116 can also clean other image forming device moving surfaces, including but not limited to moving transfer surfaces such as biased transfer belts, biased transfer rolls, or intermediate transfer belts.

The cleaning system 116 can be contained in a removable cartridge housing 117, if so desired, such as for example part of a print cartridge, also referred to a Xerographic Replaceable Unit (XRU). The XRU can be removed from the image forming device 110 and discarded when its useful life has been depleted.

The cleaning system 116 includes a first cleaning blade 120 having a cleaning blade member 122 extending from a blade holder 124 and terminating in an end 129. The blade, when placed against the surface of the photoreceptor 114, removes excess waste toner which is directed toward a toner removal auger 190 that removes the waste toner from the cleaner unit 116. Waste toner may then be discarded, recycled, etc. The cleaning system 116 also includes a second cleaning blade 140 having a cleaning blade member 142 extending from a blade holder 144 and terminating in an end 149. The cleaning blade members 122, 142 can be formed of a compliant material, such as polyurethane, which enable the blade members to bend or deflect when moved into cleaning contact with the moving surface 114.

The cleaning system 116 includes a pair of first links 160 formed of a rigid material, such as metal, plastic, composites or the like. The first links 160 are connected to opposite lateral ends of the cleaning blades 120 and 140 to couple the cleaning blades together for moving one blade member into a cleaning position while simultaneously moving the other blade into a corresponding suspended position. The first links 160 are similar, and thus only one first link is shown in detail for the purposes of clarity. The first links 160 include first pivot connections 162 pivotally connected to the distal portions 134 of the oppositely disposed lateral ends 126 and 128 of the first blade holder 124. The first links 160 also include second pivot connections 164 pivotally connected to the distal portions 154 of the lateral ends 146 and 148 of the second blade holder 144. The first links 160 also include third pivot connections 166 pivotally connected to one or more frame members 167, enabling the first links to rotate about a fixed axis A while preventing non-pivoting displacement of the first links with respect to the frame. The frame 167 can be part of the cartridge 117, or a support member attached to the image forming device 110.

The cleaning system 116 also includes a pair of second links 170 formed of a rigid material, such as metal, plastic, composites or the like. The second links 170 are connected to opposite lateral ends of the cleaning blades 120 and 140 to also couple the cleaning blade members together. The second links 170 are similar, and thus only one second link is shown in detail for the purposes of clarity. The second links 170 include first pivot connections 172 pivotally connected to the proximate portions 132 of the oppositely disposed lateral ends 126 and 128 of the second blade holder 124. The second links 170 also include second pivot connection 174 pivotally connected to the proximate portions 152 of the lateral ends 146 and 148 of the second blade holder 144. The second links 170 also include third pivot connections 176 pivotally connected to one or more of the frame members 167, enabling the second links to rotate about a fixed axis B.

Figure 5:
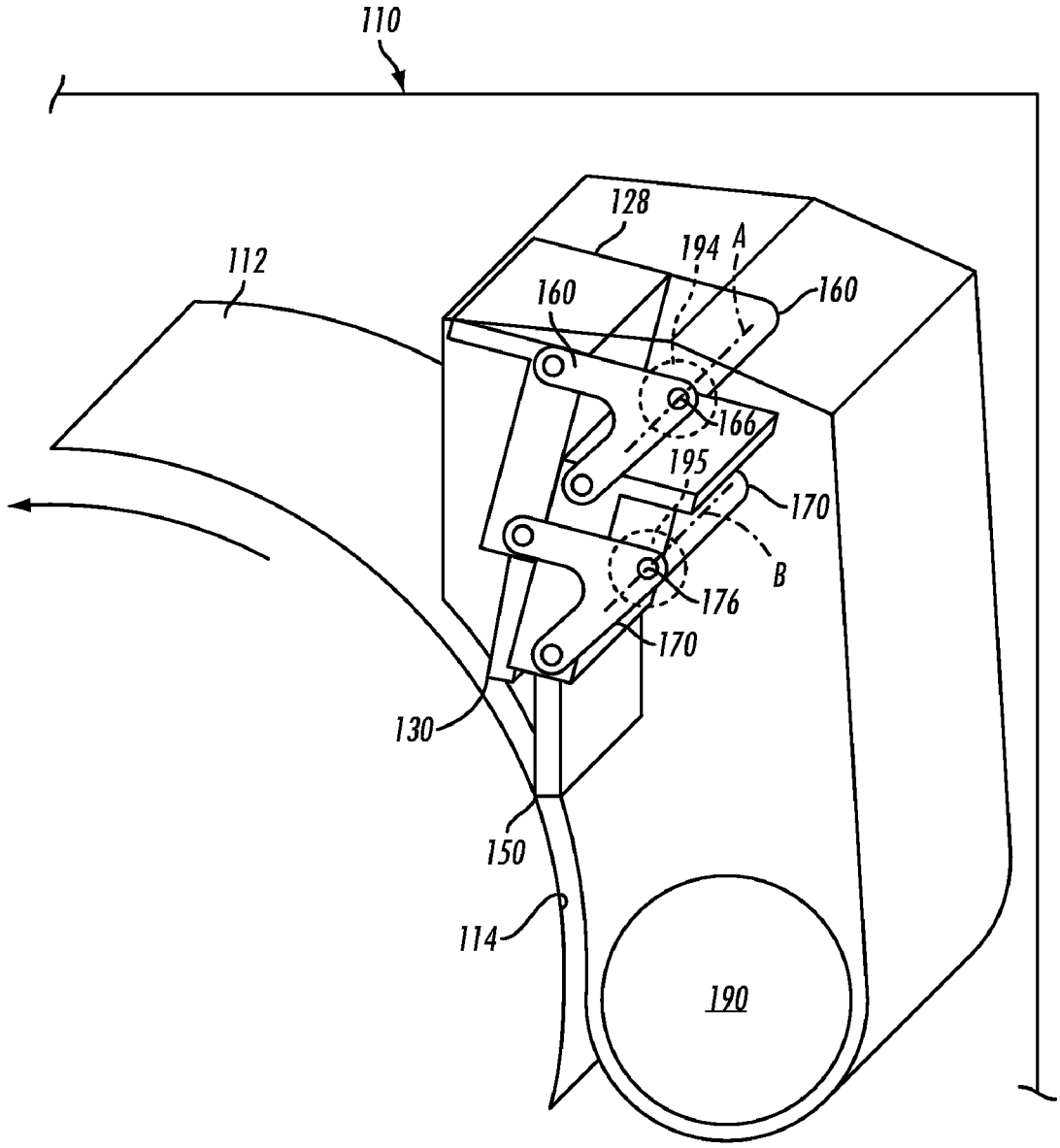
FIG. 5 is a perspective view of the two blade cleaning system of FIG. 4 having a doctor blade arrangement as described herein with a second cleaning blade disposed in the cleaning position.

The first and second link pivot connections 162, 164, 166, 172, 174, and 176 can be formed by fasteners, such as rivets, bolts or the like extending from the blade holders 124, 144 or frame 167, and through apertures in the first and second links 160, 170, or in other manners which enable relative rotation at the connections. The pivot connections 162, 164 and 166 are disposed in a triangular arrangement on the first links 160, and the pivot connections 172, 174 and 176 are disposed in a triangular arrangement on the second links 170. The first and second links 160, 170 can be V-shaped, each having 2 legs extending from the third pivot connections 166, 176 with the first pivot connections 162, 172 and second pivot connections 164, 174 disposed at the ends thereof, as shown in FIGS. 4 and 5. Such an arrangement can enable the links to be located close to each other without interfering in their movement. Other examples of the links 160, 170 can have triangular shapes with the pivot connections disposed at the vertices thereof. Other examples of the links can have other shapes.

An actuator 194, as shown in FIG. 5, can be connected to one of the first links 160 to rotate it about the third pivot connection 166. The actuator 194 can be a solenoid, or stepper motor, or some other actuator capable of rotating the first link 160 at connection 166. The actuator 194 can be disposed at the third pivot connection 166, or it can be disposed in another location and connected to the first link 160, such as by gears, arms, etc. so as to provide rotational movement to the first link 160. Other actuator arrangements capable of rotating the first and second links 160 and 170 about the third pivot connections, 166 and 176 respectively, are contemplated including, but not limited to using an actuator, shown at 195, connected to one of the second links 170 to rotate it about the third pivot connection 176, or two actuators 194 connected to each of the first links 160 or two actuators 195 connected to each of the second links 170 for rotating them about the third pivot connections 166 and 176, respectively. The first or second link driven by the actuator 194 or 195, for rotation can be referred to as the drive link, whereas the undriven link can be referred to as the follower link.

A small amount of clearance is intentionally introduced into pivot connections 166 and 176 of blade holders 124 and 144, respectively, in order to be able to vary the interference on one end of the blade slightly from the interference on the other end of the blade. By using this variation and a stepper motor on each end of the blade, independent adjustments of each blade end interference and thus blade load can be obtained. Both inboard and outboard cleaning evaluation toner patches are developed. The stepper motors independently adjust inboard and outboard blade interference until both toner patches are cleaned with the minimum blade load. This procedure aligns the cleaning blade to the photoreceptor based on cleaning performance. The alignment is independent of variability in parts and assembly.

Figure 6:
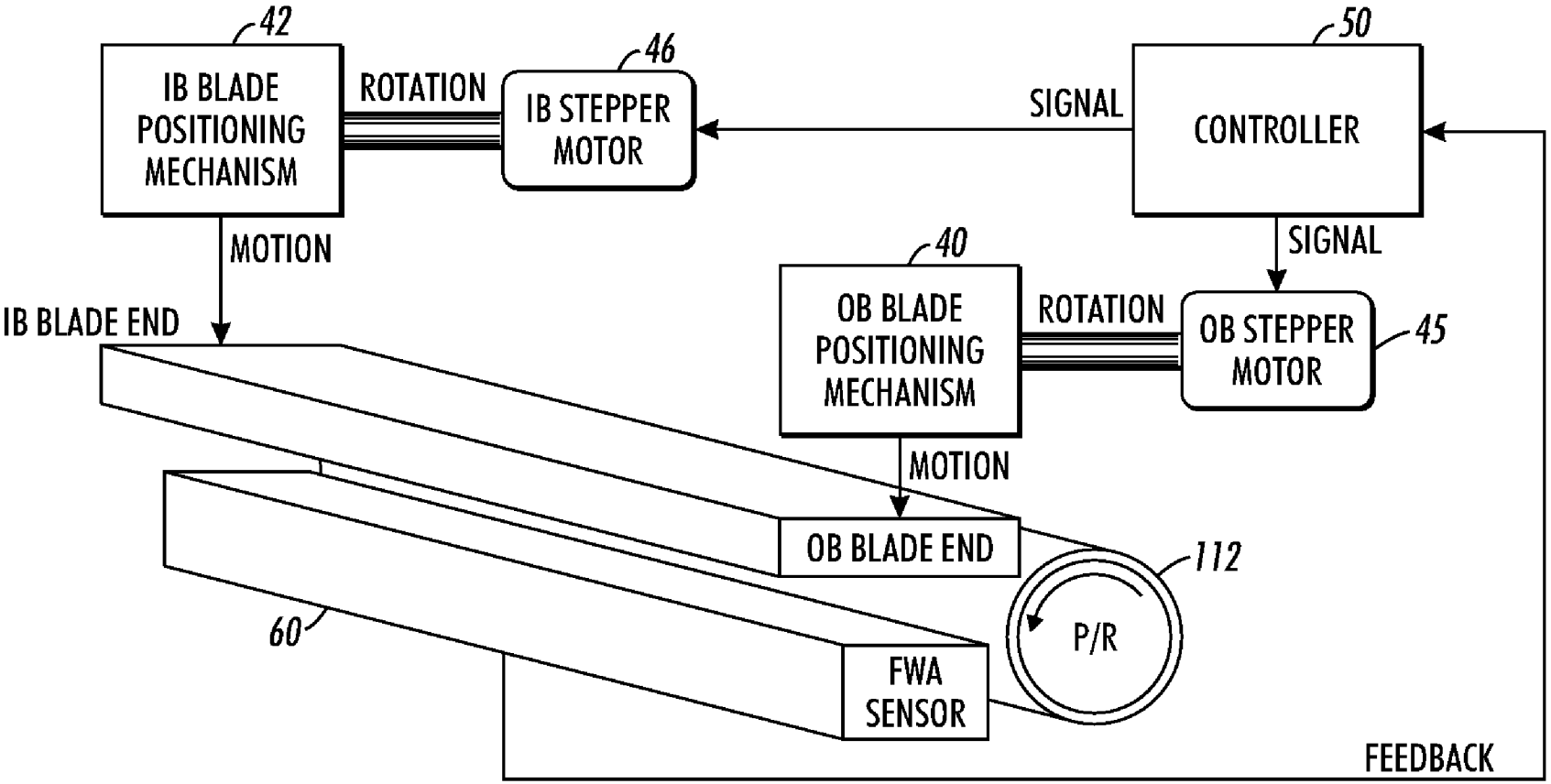
FIG. 6 is a schematic of a two stepper motor system used in the cleaning system of FIG. 1 to control blade load to a minimum required for cleaning and to align the blade to the photoreceptor.

A schematic of the cleaning performance control system for FIGS. 4 and 5 is shown in FIG. 6 that includes two stepper motors 45 and 46 operatively connected in this example to pivot connection 166 to thereby manipulate cleaning blade 122. It should be understood that pivot connection 176 is operatively connected to stepper motors on opposite ends of blade 142 as well for manipulating the second blade. As photoreceptor 112 rotates in the direction of the arrow, toner patches on either side of the photoreceptor are sensed by FWA 60. Rotation of blade holder 124 through blade positioning mechanism 40, which could be a shaft or other conventional mechanism, controls the amount of interference for each blade in the assembly. By controlling the amount of rotation, the blade load can be varied. Stepper motors 45 and 46 are used to provide rotation of blade holder 124 in defined increments. Full width array (FWA) sensor 60 is positioned after cleaner 116 to provide a detection system for streaks of toner passing under the cleaning blade. The output from the FWA sensor is input to a controller 50. Controller 50 sends a signal to stepper motors 45 and 46 which controls outboard blade positioning mechanism 40 and inboard blade positioning 42 to increase blade interference until feedback from the FWA sensor 60 indicates that the cleaning defect has been eliminated. Because cleaning failures are visible on the surface of photoreceptor 112 well before they are visible on prints, the operator on the machine will be unaware of any cleaning problem and cleaning monitoring need not be continuous.

Figure 7:
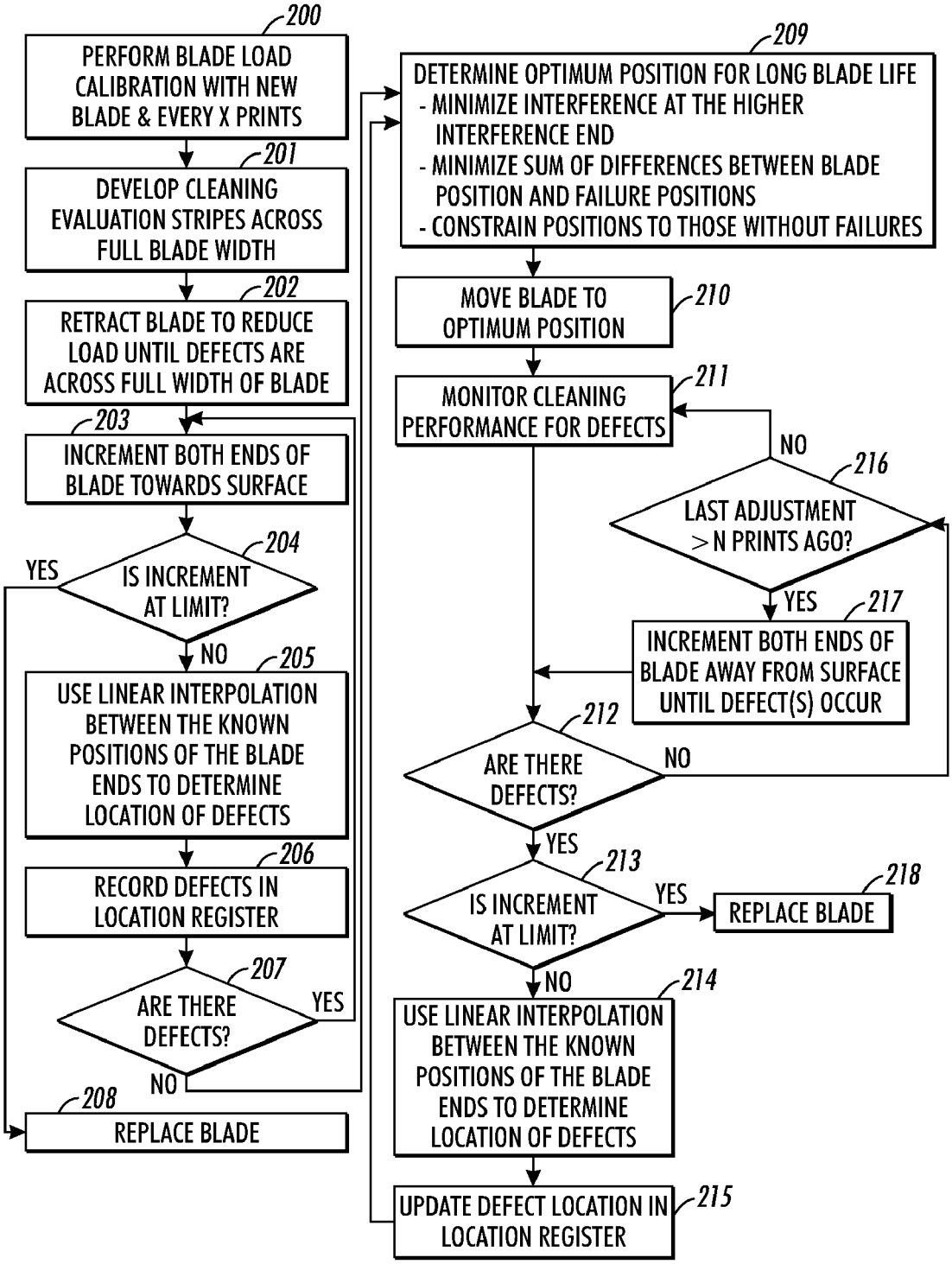
FIG. 7 is a flowchart of a process to determine minimum blade load calibration on a photoreceptor with a two stepper motor system with every new blade and after every predetermined number of prints.

FIG. 7 is a flow chart of the process for performing blade load calibration with new blades and after every predetermined number of prints. In block 200 the process is initiated and in block 201 a cleaning stripe across the full width of the photoreceptor 14 is developed. The blade is incrementally retracted to reduce blade load on the surface of the photoreceptor until defects are recognized across the full width of the blade in block 202. Both ends of the blade are incremented toward the surface of the photoreceptor in block 203 and a decision is made in block 204 as to whether or not the incrementing is at its limit. If the answer is YES, as shown in block 208, the blade is replaced. If the answer is NO, linear interpolation is used in block 205 between the known positions of the blade ends to determine location of defects. The defects are recorded in a location register in block 206 and the question is asked in block 207 as to whether there are defects. If the answer is YES, the process is repeated in blocks 203-207. If the answer is NO, a determination is made in block 209 as to the optimum position for long blade life based on: minimizing interference at the higher interference end; minimizing the sum of differences between blade position and failures positions; and constraining positions to those without failure.

Afterwards, the blade is moved in block 210 to its optimum position. Cleaning performance is monitored in block 211 for defects. A decision is made in block 212 as to whether there are any defects. If the answer is NO, a decision is made in block 216 as to whether the last adjustment was greater than a predetermined number of prints ago. If the answer in block 216 is YES, both ends of the blade are incremented away from the photoreceptor surface to reduce blade load until one or more defects occur and the inquiry is made as to whether there are any defects in block 212. If the answer in block 216 is NO, cleaning performance is monitored for defects in block 211 with the process proceeding then to block 212 with the decision as to whether or not there are any defects. If the answer is YES in block 212, a decision is made as to whether or not the incrementing limit has been reached in block 213. If that answer is YES, the blade is replaced as shown in block 218. However, if the answer is NO, linear interpolation is used between the known positions of the blade ends to determine the location of defects in block 214 and the defect location register is updated in block 215 and the process is repeated starting with block 209.

It should be understood that while the variable interference cleaning blade system hereinabove has been shown in a multi-blade system, it is adaptable and equally effective in a single blade cleaning system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A variable interference cleaning blade method for maintaining minimum cleaning blade alignment and load against a surface to be cleaned, comprising;

providing a surface to be cleaned;

providing at least one cleaning blade mounted within a blade holder and positioned for cleaning said surface;

providing a first blade positioning mechanism drivingly connected to one end of said cleaning blade holder for moving said cleaning blade;

providing a first stepper motor drivingly connected to said first blade positioning mechanism for rotating said first blade positioning mechanism;

providing a sensor positioned downstream of said cleaning blade for sensing a cleaning defect;

providing a controller for receiving signals from said sensor and in turn sending a signal to actuate said first stepper motor to thereby move said cleaning blade against said surface to increase cleaner blade interference against said surface until feedback from said sensor indicates that the cleaning defect has been eliminated and thereafter maintaining the cleaning blade load above the minimum for cleaning; and optimizing cleaning blade life by keeping the cleaning blade load at the minimum load for cleaning by providing a toner patch on at least one side of said surface to be cleaned for toner cleaning evaluation.

2. The method of claim 1, wherein said surface is a photoreceptor.

3. The method of claim 2, wherein said sensor is a full width array.

4. The method of claim 3, wherein said cleaning defect is in the form of toner.

5. The method of claim 4, wherein said full width array sensor detects streaks of toner passing under said cleaning blade.

6. The method of claim 4, including developing toner on said at least one toner patch.

7. The method of claim 4, comprising increasing the cleaner blade interference against said photoreceptor if said full width array sensor detects toner past said cleaning blade until the minimum load for cleaning is reached.

8. The method of claim 7, comprising decreasing the cleaner blade interference against said photoreceptor if said full width array sensor does not detect toner past said cleaning blade until the minimum load for cleaning is reached.

9. The method of claim 1, including performing said optimizing of said cleaning blade life during a predetermined cleaning cycle.

10. The method of claim 1, wherein said predetermined cleaning cycle is during machine cycle-up.

11. The method of claim 1, wherein said predetermined cleaning cycle is during machine cycle-down.

12. The method of claim 1, wherein said predetermined cleaning cycle is performed within inter-document zones.

13. The method of claim 1, including providing a toner patch on both sides of said photoreceptor.

14. The method of claim 13, including developing toner on both of said toner patches.

15. The method of claim 14, providing a second blade positioning mechanism drivingly connected to the opposite end of said cleaning blade holder for moving said cleaning blade.

16. The method of claim 15, including providing a second stepper motor drivingly connected to said second blade positioning mechanism for rotating said second blade positioning mechanism and thereby moving said cleaning blade.

17. The method of claim 16, including independently adjusting said one end and opposite end of said blade holder with said first and second stepper motors based on signals from said controller until both toner patches are cleaned with the minimum blade load, thereby aligning the cleaning blade to the photoreceptor based on cleaning performance.

* * * * *